US011215947B2

(12) United States Patent
Feygelman

(10) Patent No.: US 11,215,947 B2
(45) Date of Patent: Jan. 4, 2022

(54) SELECTIVE PRIMER REMOVAL

(71) Applicant: HP INDIGO B.V., Amstelveen (NL)

(72) Inventor: Alex Feygelman, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 122 days.

(21) Appl. No.: 16/603,801

(22) PCT Filed: Apr. 18, 2017

(86) PCT No.: PCT/EP2017/059211
§ 371 (c)(1),
(2) Date: Oct. 8, 2019

(87) PCT Pub. No.: WO2018/192643
PCT Pub. Date: Oct. 25, 2018

(65) Prior Publication Data

US 2020/0117133 A1 Apr. 16, 2020

(51) Int. Cl.

| | |
|---|---|
| ***G03G 21/00*** | (2006.01) |
| ***B05C 1/08*** | (2006.01) |
| ***G03G 15/00*** | (2006.01) |

(52) U.S. Cl.
CPC ..... *G03G 21/0052* (2013.01); *B05C 1/0817* (2013.01); *G03G 15/6585* (2013.01)

(58) Field of Classification Search
CPC ..... B05C 1/0817; B05C 1/0813; B05C 1/08; B41F 31/007; B41F 31/027; B41F 31/20; B41F 33/0054; B41J 11/0015
See application file for complete search history.

(56) References Cited

U.S. PATENT DOCUMENTS

| | | | | |
|---|---|---|---|---|
| 3,760,722 | A | 9/1973 | Thorson et al. | |
| 4,527,479 | A | 7/1985 | Dahlgren et al. | |
| 4,948,635 | A | 8/1990 | Iwasaki | |
| 5,598,777 | A | 2/1997 | DeMoore et al. | |
| 6,125,756 | A * | 10/2000 | Nussel | B41C 1/1058 101/453 |
| 6,145,437 | A * | 11/2000 | Bock | B41F 31/007 101/349.1 |
| 2009/0220701 | A1 | 9/2009 | Furukawa et al. | |
| 2011/0091249 | A1* | 4/2011 | Murakami | G03G 21/206 399/323 |
| 2014/0267482 | A1 | 9/2014 | LeFevre et al. | |
| 2017/0266952 | A1* | 9/2017 | Kress | B41F 33/0054 |

FOREIGN PATENT DOCUMENTS

| | | |
|---|---|---|
| DE | 29805201 | 5/1998 |
| EP | 1243346 | 9/2002 |
| EP | 2641942 | 9/2013 |
| JP | S5795465 A | 6/1982 |

OTHER PUBLICATIONS

Loparex Backing your products, backing your business, < http://www.loparex.com/en/glossary.aspx >.

* cited by examiner

*Primary Examiner* — John Zimmermann
(74) *Attorney, Agent, or Firm* — Mannava & Kang

(57) ABSTRACT

In one example, an apparatus for selectively removing primer in a printing system is described, having a chamber for supply of a pressurised fluid, a plurality of valves fluidically coupled to the chamber and individually pivotable about a common elongate member that extends along a length of the apparatus, and a set of actuators to pivot the plurality of valves about the elongate member to selectively supply pressurised fluid from the chamber along the length of the apparatus.

15 Claims, 4 Drawing Sheets

SELECTIVE PRIMER REMOVAL

BACKGROUND

Priming treatment may be applied to particular types of print media or substrates prior to the application of printing fluid or toner. This may be performed to improve adhesion of the printing fluid or toner to the print medium or substrate. This kind of treatment is usually performed by a page-wide roller at a stage when the print medium or substrate is fed from another roller, in order to apply the priming treatment uniformly and evenly. However, it is desired to selectively apply a priming treatment to the print medium or substrate.

BRIEF DESCRIPTION OF THE DRAWINGS

Various features of the present disclosure will be apparent from the detailed description which follows, taken in conjunction with the accompanying drawings, which together illustrate, certain examples, and wherein.

DETAILED DESCRIPTION

Figure 2A:
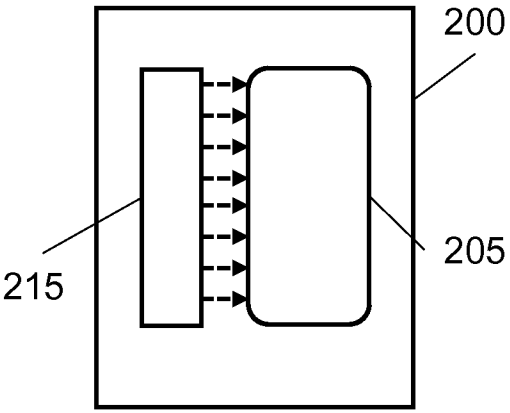
FIG. 2*a* is a schematic illustration showing a top-down view of a priming station for a printing system, according to an example.

In certain printing operations it may be desired to leave a print substrate uncoated at particular locations on a surface of the print substrate. For example, in fields relating to printing packaging materials, such as shrink sleeve labels, a special solution such as a bonding agent may be applied to the print substrate as part of the packaging process after printing. The presence of a coating on the print substrate, such as primer or printing fluid, may impede the bonding agent or other special solution in its function.

In these cases, the deposit of printing fluid may be controlled using a printing device of the printing system. For example, print data may be configured such that printing fluid is not applied to substrate areas that become bonding strips. However, primer, or priming solution, is often applied in a priming station indiscriminately, e.g. by a page-wide roller. It may therefore be desired to apply the primer, or priming solution, to the print substrate selectively.

By selectively applying primer, areas of the print substrate without primer may be provided. In these areas, a special solution may then be applied to the print substrate, without being impeded in its function, after printing. For example, for shrink sleeve labels, it may be desired to produce a label with a narrow unprinted strip, having no primer present on the unprinted strip, where a bonding agent may be applied to bond the label to a packaging item such as a plastic bottle.

Being able to selectively apply primer has other benefits. For example, it may also be desired to reconfigure a selective application of primer to the print substrate for different print jobs. For example, different print jobs may have different sizes or types of print substrate, as well as varying configurations for the selective application of primer to the particular print substrate, e.g. certain areas may be gloss and other areas matt.

In comparative methods, selective application of primer may be attempted using specially adapted equipment, such as bespoke rollers, for each individual print job. However, having to store and utilize such custom-made equipment for each individual print job can be inefficient. Furthermore, many primers have a relatively high pH level (between 11 and 13) which may damage roller materials (e.g. EPDM rubber) and cause issues with print quality, reliability, and maintenance of the rollers and/or priming unit.

Given this background, certain examples described herein provide an apparatus, a priming station, and a method for use in a printing system. The apparatus, priming station and method each relate to selectively removing primer in a printing system, for example from a metering roller or other receiving medium, to enable selective application of primer to a printing substrate. The examples described herein may simplify a priming unit design, reduce unit cost, minimize maintenance of a priming unit, improve utilization of a printing system, and/or save storage space.

Certain examples will now be described with reference to the Figures.

Figure 1:
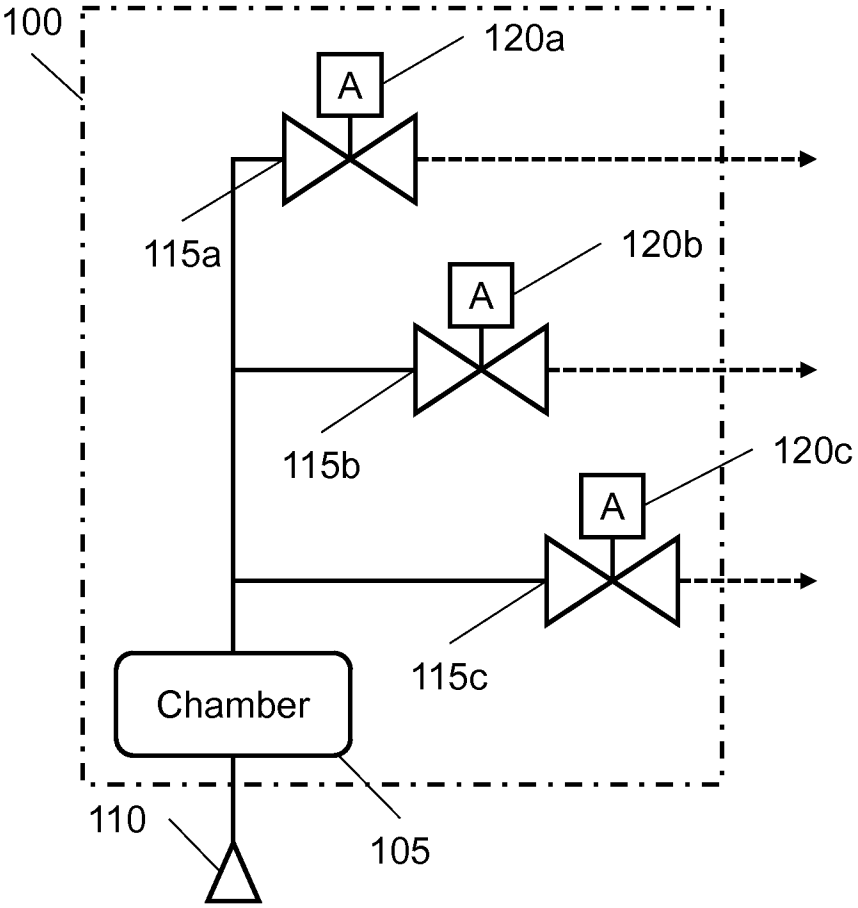
FIG. 1 is a schematic illustration showing an apparatus for selectively removing primer in a printing system according to an example.

FIG. 1 shows schematically an apparatus 100 for selectively removing primer in a printing system according to an example. The apparatus 100 comprises a chamber 105 for supply of a pressurised fluid 110. The chamber 105 may, for example, be an air chamber containing compressed air at a pressure of 6 bar (0.6 MPa).

The apparatus 100 comprises a plurality of valves 115*a*, 115*b*, 115*c* fluidically coupled to the chamber 105. The valves may be 1 mm thick in examples, and may be made of metal such as stainless steel. In a particular example, the valves are made of full hard stainless steel type 301 or 302. The phrase "fluidically coupled" indicates that the pressurised fluid 110 supplied by the chamber 105 may travel from the chamber 105 to the plurality of valves 115*a*, 115*b*, 115*c*, such as via a channel, tube, opening or similar. The flow of the pressurised fluid 110 to the plurality of valves 115*a*, 115*b*, 115*c* is shown by the respective solid portions of the arrows in FIG. 1, with the dashed portions showing the respective potential flow of the pressurised fluid 110 through each of the plurality of valves 115*a*, 115*b*, 115*c*, dependent on whether each valve is open or closed. Three valves are shown in this example but any plurality of valves may be provided in implementations.

The plurality of valves 115*a*, 115*b*, 115*c* are individually pivotable about a common elongate member (not shown in FIG. 1) that extends along a length of the apparatus 100. The common elongate member may comprise a rod or shaft aligned with an axis of the apparatus 100. The apparatus may extend, in use, across a width of a print substrate. The plurality of valves 115*a*, 115*b*, 115*c* may be spaced on the common elongate member and along its length. In this example, the phrase "individually pivotable" indicates that each of the plurality of valves 115*a*, 115*b*, 115*c* may pivot or rotate about the common elongate member independently of the other valves. For example, each of the plurality of valves 115*a*, 115*b*, 115*c* may rotate by 1 to 10 degrees. Pivoting of each value may open and/or close the valve and hence control supply of pressurised fluid 110 from the chamber 105. In one example, each valve in the plurality of valves 115*a*, 115*b*, 115*c* has a width of 4 mm along the length of the common elongate member, to produce a lane of pressurised fluid supply having a width of 4 mm (with a maximum error of +/−1 mm) when actuated.

The apparatus 100 also comprises a set of actuators 120*a*, 120*b*, 120*c*—labelled 'A' in FIG. 1—to pivot the plurality of valves 115*a*, 115*b*, 115*c* about the elongate member. The actuators may pivot the valves by activation of an air piston in one example. If each valve comprises a pivotable member, then an actuator may provide a force to one end of the pivotable member so as to pivot the member. In the example shown in FIG. 1, the set of actuators 120*a*, 120*b*, 120*c* has the same number of actuators as valves within the plurality of valves 115*a*, 115*b*, 115*c*. Thus, in this example, each actuator is paired or coupled with a valve within the plurality of valves 115*a*, 115*b*, 115*c*. In other examples, there may be fewer actuators in the set of actuators 120*a*, 120*b*, 120*c* than valves in the plurality of valves 115*a*, 115*b*, 115*c*. In one example, the set may comprise a single actuator. In cases, where there are fewer actuators than valves, at least one actuator may control more than one valve. In one case, a single, moveable actuator may control all of the plurality of valves 115*a*, 115*b*, 115*c*.

In certain cases, each of the set of actuators 120*a*, 120*b*, 120*c* is moveable along a length of the elongate member, and may selectively pivot multiple valves within the plurality of valves 115*a*, 115*b*, 115*c*. For example, there may be fewer actuators than valves, with the actuators able to move between multiple valves. In an example, there may be one actuator which is able to move between, and selectively pivot or actuate, all valves in the plurality of valves 115*a*, 115*b*, 115*c*. The actuator(s) may be moveable along the length of the elongate member by a sliding carriage system, with the actuator attached to a carriage mounted on sliders.

As the plurality of valves 115*a*, 115*b*, 115*c* are individually pivotable, the set of actuators 120*a*, 120*b*, 120*c* may pivot the plurality of valves 115*a*, 115*b*, 115*c* about the elongate member to selectively supply pressurised fluid 110 from the chamber 105 along the length of the apparatus 100. As an example, a first valve 115*a* and a second valve 115*b* in the plurality of valves 115*a*, 115*b*, 115*c* may be pivoted or actuated respectively by a first actuator 120*a* and a second actuator 120*b* in the set of actuators 120*a*, 120*b*, 120*c*, but a third valve 115*c* may, in this example, not be pivoted by a third actuator 120*c* in the set of actuators 120*a*, 120*b*, 120*c*. Thus, the pressurised fluid 110 may be supplied from the chamber 105 and via the actuated first and second valves 115*a*, 115*b* to outside the apparatus 100, but not via the unactuated third valve 115*c*. In this way, the pressurised fluid 110 is selectively supplied from the chamber 110 along the length of the apparatus for selectively removing primer, for example from a medium with primer applied to it, in a printing system. In this case, if the apparatus is arranged across a width of the medium, then primer may be selectively applied across said width, e.g. enabling primer to be selectively applied across a width of a print substrate.

Figure 2B:
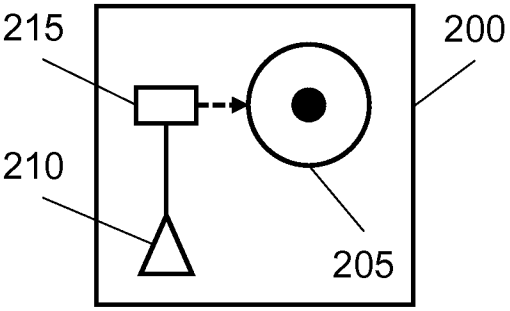
FIG. 2*b* is a schematic illustration showing a side view of the priming station of FIG. 2*a*, according to an example.

FIGS. 2*a* and 2*b* show schematically a priming station 200 for a printing system according to an example in top-down and side-on views, respectively. FIGS. 2*a* and 2*b* demonstrate how the apparatus 100 may be used within a priming station 200.

In FIGS. 2*a* and 2*b*, the priming station 200 comprises a metering roller 205 to carry primer fluid for application to a printing substrate. The printing substrate may first pass through the priming station 200 in a printing system, where the primer fluid is applied to it, before being transported to a printing station, where printing fluid may be applied on top of the primer fluid. The primer fluid may therefore be a fluid suitable for application in a printing process and may comprise a fluid for pre-treatment of the printing substrate e.g. a primer or priming solution to be applied to the printing substrate before the deposit of printing fluid. In certain cases, the primer fluid is a liquid. The primer fluid may, in certain cases, improve adhesion of the applied printing fluid or ink with the printing substrate.

The metering roller 205 may be a cylinder comprising a surface upon which primer fluid is deposited. In this case, the primer fluid may be transferred to the printing substrate by way of rotation of the cylinder. For example, the metering roller 205 may be an anilox roll. In one case, the transfer of primer fluid to the printing substrate is achieved using an application roller (not shown) that receives fluid from the metering roller 205 and applies it to the printing substrate. In certain cases, the metering roller 205 may have depressions or dimples on its surface for receiving and carrying the primer fluid. The metering roller 205 provides desirable metering of the primer fluid onto the printing substrate.

Returning to FIGS. 2*a* and 2*b*, the priming station 200 also comprises a pressurised air supply 210 and an addressable air knife 215. The pressurised air supply 210 may supply compressed air or gas from a chamber or canister. This may be equivalent to fluid supply 110 in FIG. 1. In the Figures, the addressable air knife 215 is mounted opposite the metering roller 205. The air knife 215 comprises a plurality of valves in fluidic communication with the pressurised air supply 205. The plurality of valves extend along a width of the metering roller 205 and are individually addressable to selectively remove primer fluid from the metering roller 205. For example, the plurality of valves in the air knife 215 may be an implementation of the plurality of valves 115*a*, 115*b*, 115*c* shown in the example apparatus of FIG. 1. The dashed arrows in FIGS. 2*a* and 2*b* show the potential flow of pressurised air from the pressurised air supply 205 via the plurality of valves, and applied to the metering roller 205 to selectively remove primer fluid from it, in the same way the dashed arrows FIG. 1 show the potential flow of pressurised fluid 110 via the plurality of valves 115*a*, 115*b*, 115*c*.

The plurality of valves in the air knife 215 are individually addressable such that each valve can be activated to allow the pressurised air supply 205 to flow through the valve and onto the metering roller 205 mounted opposite the air knife 215. In this way, a particular valve may be addressed or activated to selectively remove primer fluid from the metering roller 205 in a respective channel or lane that the valve corresponds to. For example, the plurality of valves extend along the width of the metering roller 205, as shown in FIG. 2*a*, wherein each valve corresponds to a portion of the metering roller 205 along its width (a so-called "lane"). Pressurised air may be selectively supplied through a valve and applied to the metering roller 205 in the respective portion of the metering roller 205 to remove primer from the metering roller 205 in that portion (or lane). In this way, it is possible to select which of the valves in the air knife 215 are activated or addressed in order to remove primer from the metering roller 205 in particular lanes corresponding to the addressed valves. For example, a one-dimensional control array may indicate whether a valve along the length of the metering roller 205 is to be activated. This array may comprise binary values if a valve has two states (e.g. off and on) or quantised values representing different opening states (e.g. a 4-bit control value may indicate 16 different degrees of opening).

In one example, the metering roller 205 rotates and the air knife 205 is controllable in time. Thus, a desired two-dimensional pattern of primer fluid presence on a printing substrate may be attained by selecting which of the valves in the air knife 215 should be addressed to selectively remove primer fluid from the surface of the metering roller 205 in a pattern (corresponding to the desired two-dimensional pattern) prior to transferring the remaining primer fluid from the metering roller 205 to the printing substrate. The timing of the valves and the rotation of the metering roller 205 may be synchronised to selectively remove primer from the metering roller 205 in two-dimensions, i.e. with respect to the surface of the roller.

In certain examples, the priming station 200 comprises an interface to receive data indicative of a desired pattern of primer fluid application for a printing substrate. For example, the data may comprise a bitmap or similar data representation corresponding to the desired pattern of primer fluid. The priming station 200 may also comprise a controller to control the plurality of valves of the addressable air knife 215 to selectively remove primer fluid from the metering roller 205. In certain cases, the controller may be communicatively coupled to the interface, such that the received data indicative of the desired pattern is transferred to the controller where it is processed and used as command input to control the plurality of valves.

Further examples will now be described setting out in more detail potential configurations of the apparatus 100 and/or air knife 200. These configurations are set out to better understand the operation of the described examples.

Figure 3A:
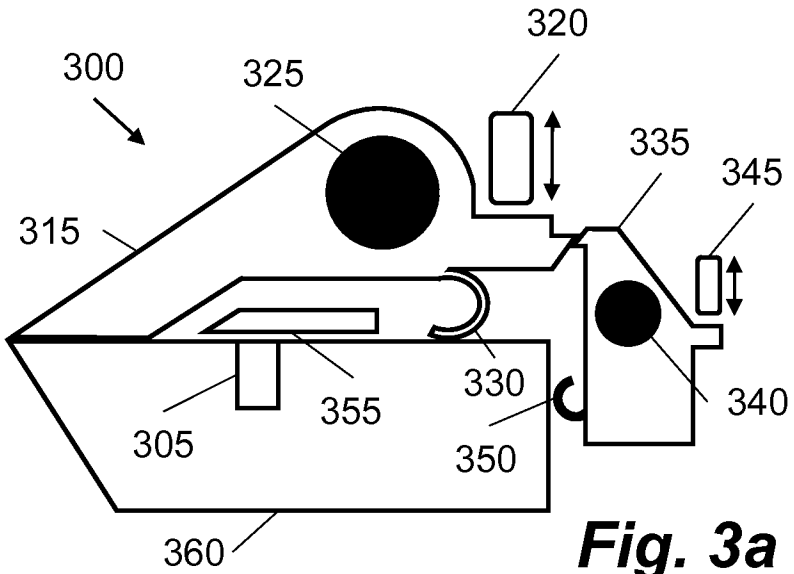
FIG. 3*a* is a schematic illustration showing a side-on cutaway view of an apparatus for selectively removing primer in a printing system, according to an example.
Figure 3B:
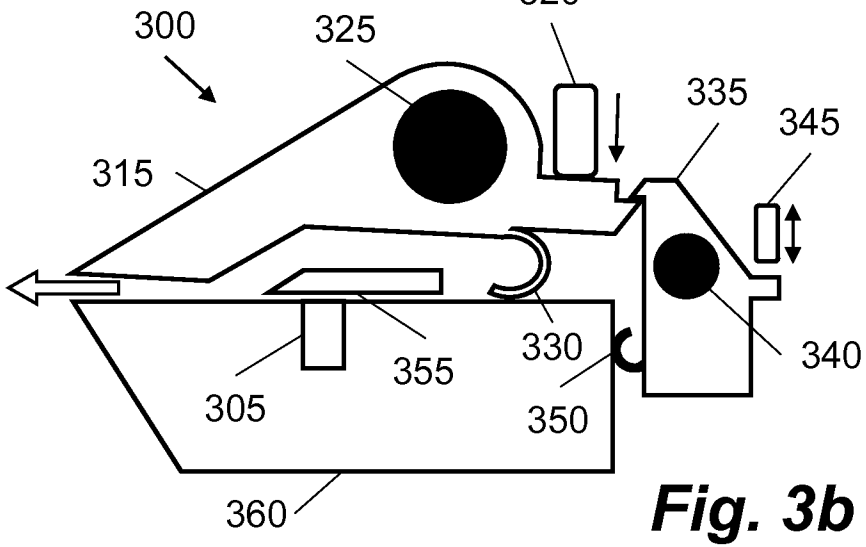
FIG. 3*b* is a schematic illustration showing a side-on cutaway view of the apparatus of FIG. 3*a* in a different configuration, according to an example.

FIGS. 3*a* and 3*b* show a side-on perspective of an apparatus 300 for selectively removing primer in a printing system, according to a specific example. As described with reference to the example apparatus 100 shown in FIG. 1, the apparatus 300 comprises a chamber 305 for supply of a pressurised fluid, a plurality of valves 315 and a set of actuators 320. The plurality of valves 315 are fluidically coupled to the chamber 305. The valves 315 are also individually pivotable about a common elongate member 325 that extends along a length of the apparatus 300. The common elongate member 325 may be a rod or shaft. The set of actuators 320 may pivot the plurality of valves 315 about the elongate member 325 to selectively supply pressurised fluid from the chamber 305 along the length of the apparatus 300. FIG. 3*b* shows a valve 315 pivoted about the common elongate member 325 by an actuator 320. The pivoted valve 315 has been pivoted into an open configuration in FIG. 3*b*, such that pressurised fluid from the chamber 305 may be supplied via the pivoted valve 315. In this pivoted configuration, the valve 315 may be considered actuated, activated, or open.

The plurality of valves 315 may be positioned along a length of the common elongate member 325 such that selectively pivoting valves in the plurality of valves 315 allows pressurised fluid from the chamber 305 to be selectively supplied along the length of the apparatus 300, as described previously in the example of FIG. 1. Each valve 315 in the plurality of valves positioned along a length of the common elongate member 325 may correspond to a portion of the length of the common elongate member 325 (or lane) such that pressurised fluid from the chamber 305 may be selectively supplied through a valve 315 in the respective portion of the length of the common elongate member 325. It is therefore possible to select which of the valves 315 are pivoted or activated in order to supply pressurised fluid from the chamber 305 in particular lanes corresponding to the pivoted or activated valves 315.

The selective supply of pressurised fluid via the selectively pivotable valves 315 may be used to selectively remove primer in a printing system (e.g. from a metering or anilox roller carrying primer, or from a printing substrate with primer applied to it). The pressurised fluid may be applied to a roller via the selectively pivotable valves 315 positioned 0.5 mm away from the roller in one case. The application of pressurised fluid to the roller is a contactless method of removing primer, with the pressurised fluid applying disruptive forces to the primer carried by the roller to remove the primer. Selectively applying pressurised fluid to the roller may therefore allow selective removal of primer from the roller. For example, selectively pivoting valves 315 along the length of the common elongate member 325 may allow primer to be removed from a roller or substrate in particular lanes on the roller or substrate corresponding to the selectively pivoted or actuated valves 315. In this way, by activating the addressable valves along the length of the apparatus 300 over time, it is possible to construct a two-dimensional pattern of primer on the roller or substrate in a printing system, which may be predetermined e.g. for a particular print job to be performed by the printing system.

In certain cases, each of the plurality of valves 315 comprises a spring member 330 and is biased in a closed configuration, as shown in FIG. 3*a*. Pivoting a valve 315 from the closed configuration to an open configuration, shown in FIG. 3*b*, may therefore act against a resistance from the spring member 330. In this way, upon release of a force acting to pivot the valve 315 to the open configuration, the valve 315 may return to the closed configuration.

In some cases, each of the set of actuators 320 is moveable along a length of the elongate member to selectively pivot multiple valves 315 within the plurality of valves 315, as described with reference to the example apparatus 100 shown in FIG. 1. In this way, an actuator 320 in the set of actuators may move between multiple valves 315 positioned along a length of the common elongate member 325 to selectively actuating the multiple valves 315 in turn. For example, the actuator 320 might have an initial position and a final position along the length of the common elongate member 325, and may move from the initial position to the final position—selectively actuating valves 315 positioned between the initial position and the final position.

In certain examples, the apparatus 300 comprises a plurality of latches 335 respectively coupled to the plurality of valves 315. The latches 335 may be made of the same material as the valves 315 e.g. spring steel. In these examples, the latches 335 are individually pivotable about a second elongate member 340 that extends along the length of the apparatus 300. The second elongate member 340 may be a rod or shaft. The axes of each elongate member 325 and 340 may be substantially parallel. Each of the plurality of latches 335 is configured to hold a valve 315 in an open configuration, shown in FIG. 3*b*, such that the pressurised fluid from the chamber 305 is supplied by the valve 315, when said valve 315 is pivoted by the set of actuators 320.

The apparatus 300 in some cases might comprise a second set of actuators 345 to pivot the plurality of latches 335 about the second elongate member 340 to selectively release the plurality of latches 335 and selectively close the plurality of valves 315. For example, during a printing operation or between printing operations carried out by a printing system, the apparatus 300 may reconfigure the selectively actuated valves 315 to selectively remove primer in a different pattern. Thus, in reconfiguring the selectively actuated valves 315 from a first configuration to a second configuration, the apparatus 300 may selectively pivot valves 315 that were closed in the first configuration, and may close valves 315 that were selectively pivoted in the first configuration. To close such selectively pivoted valves 315 when reconfiguring, the corresponding latches 335 may be actuated by the second set of actuators 345.

As described with reference to the plurality of valves 315 and set of actuators 320, in some cases there may be one actuator 345 per latch 335, whereas in other cases there may be fewer actuators 345 than latches 335. The actuators 345 in the second set of actuators may therefore be able to move between latches 335 and selectively actuate multiple latches 335.

In one example, the second elongate member 340 is controllable to actuate or pivot the plurality of latches 335 to release the plurality of valves 315. In this way, the configuration of selectively pivoted valves 315 may be reset by pivoting the plurality of latches 335 all at once, for example by rotating the second elongate member 340 to rotate the entire plurality of latches 335 to release the entire plurality of valves 315.

In certain cases, each of the plurality of latches 335 may have a spring member 350 to resist pivoting of the latch 335. Thus, interacting portions of the valves 315 and latches 335 may be shaped such that actuation of a valve 315 pivots a corresponding latch 335, which springs back after a predetermined amount of pivoting of the valve 315 to secure the valve 315 in the open configuration, as shown in FIG. 3*b*. The latch 335 may then be pivoted by an actuator 345 in the second set of actuators, or by rotating the second elongate member 340, to release the valve 315 to the closed configuration. In the open configuration, the plurality of latches 335 may hold or secure the selectively pivoted valves 315 at a predetermined height such that an outlet of a predetermined size is provided for the pressurised fluid to flow from the chamber 305 via each selectively pivoted valve 315.

In particular examples, the apparatus 300 might have a guide piece 355 to guide the pressurised fluid supply from the chamber 305. For example the guide piece 255 may force the pressurised fluid from the chamber 305 through a narrow outlet before reaching the plurality of valves 315 to form a jet or air curtain. The plurality of valves 315 may be shaped such that pressurised fluid that is blocked by a valve 315, for example when in the closed configuration shown in FIG. 3*a*, is returned to the back of the apparatus 300 i.e. the side of the apparatus 300 opposite where the pressurised fluid is supplied by the plurality of valves. In this way, pressurised fluid may be returned and reused or recycled by the apparatus 300.

In certain cases the apparatus 300 may comprise a base part 360 which the plurality of valves 315 move with respect to, to open or close and allow or block the supply of pressurised fluid from the chamber 305, respectively. The base part 360 may also contain the pressurised fluid chamber 305, as shown in FIGS. 3*a* and 3*b*. The spring members 330, 350 of the valves 315 and/or latches 335 may also contact the base part 360, in examples where respective spring members 330, 350 are present, such that the spring members 330, 350 compress between the base part 360 and the valves 315 and/or latches, respectively, when the valves 315 and/or latches are pivoted. The base part may be constructed from a single elongate bar.

Figure 4:
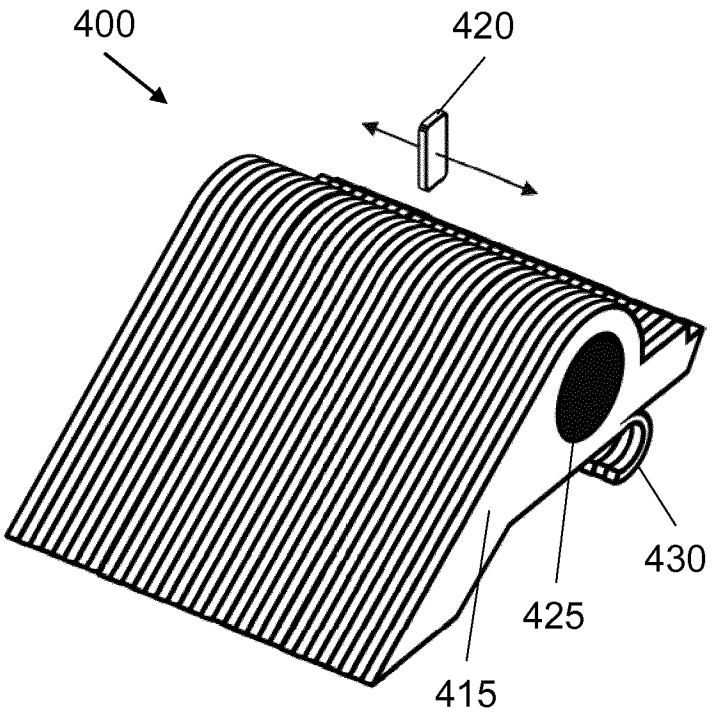
FIG. 4 is a schematic illustration showing a perspective view of an apparatus having a plurality of valves, according to an example.

FIG. 4 shows a perspective view of an apparatus 400 having a plurality of valves 415 pivotable about a common elongate member 425 that extends along a length of the apparatus 400. Each of the plurality of valves 415 comprises a spring member 430. The apparatus 400 also comprises an actuator 420. The apparatus 400 may form part of an apparatus for selectively removing primer in a printing system as described, for example the apparatuses 100, 300 shown in FIGS. 1, 3*a* and 3*b*. The actuator 420 may move along a length of the elongate member 425, in the linear directions shown by arrows in FIG. 4. For example, the actuator 420 may have an initial position at one end of the elongate member 425 and a final position at the other end of the elongate member 425, where the actuator 420 moves from the initial position to the final position and selectively pivots valves 415 as it progresses. The pivoting or actuation of a valve 415 may be by motion of the actuator 420 from a point on the actuator's axis of movement along the length of the common elongate member 425 (between the initial and final positions) towards the valve 415. An example of actuation of a valve 315 by an actuator 320 is shown in FIG. 3*b*, where the actuator 320 travels towards, and contacts with force, a portion of the valve 315 to pivot the valve 315. In this example, actuation of the valve 315 by the actuator 320 is similar to the pressing of a key on a piano, with the valve 315 acting as the key and the actuator 320 a moveable finger to press the key.

Figure 5:
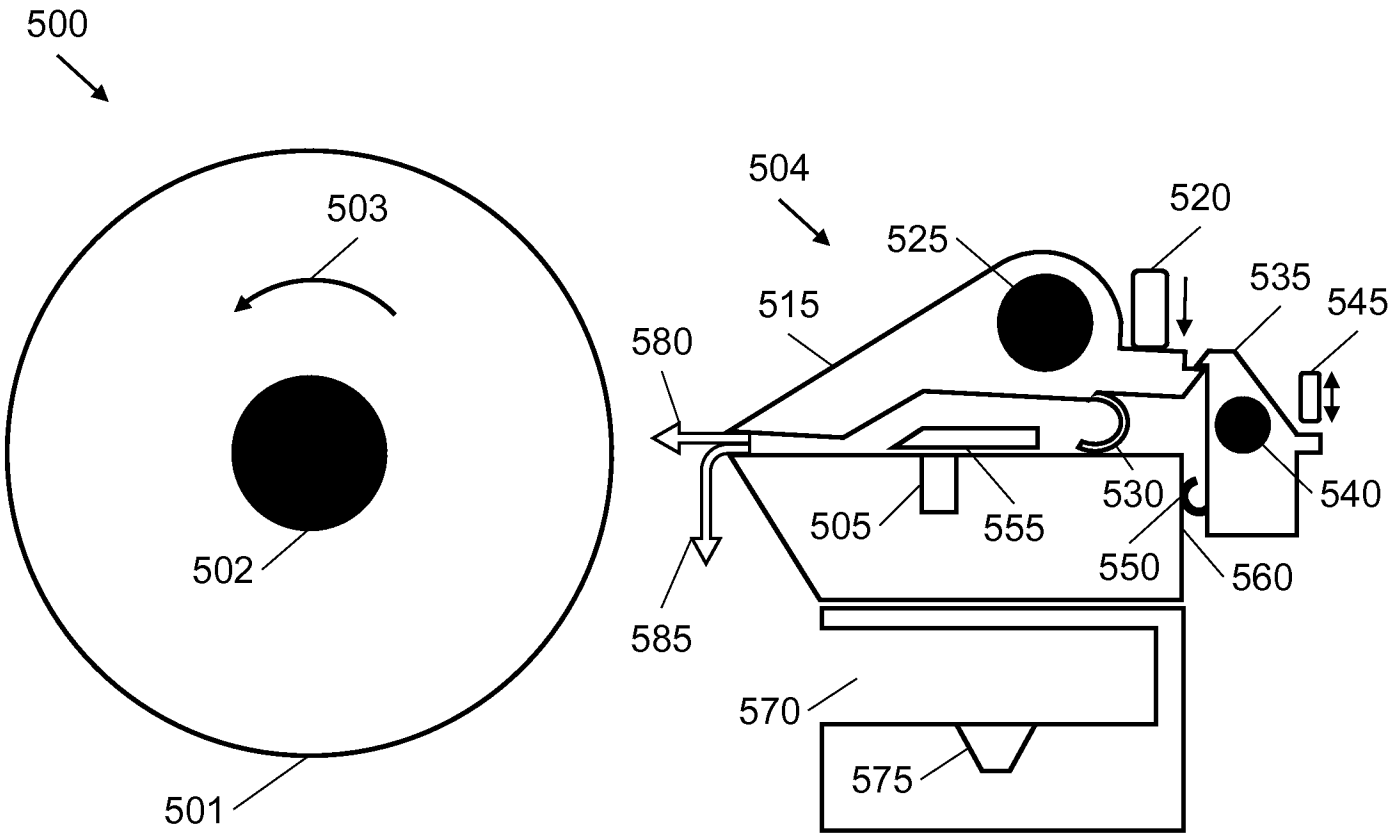
FIG. 5 is a schematic illustration showing a side-on cutaway view of a priming station for a printing system, according to an example.

FIG. 5 shows a side-on view of a priming station 500 for a printing system, according to a specific example. The priming station 500 may be a specific implementation of the priming station 200 shown in FIGS. 2*a* and 2*b*. As part of the printing system, the priming station 500 may precede a printing station in a printing system, for example, and be used to control how primer fluid is applied to a substrate before the substrate is printed on at the printing station.

The priming station 500 comprises a metering roller 501 to carry primer fluid for application to a printing substrate. In certain cases the metering roller 501 may be an anilox roll. The metering roller 501 provides desirable metering of the primer fluid onto the printing substrate, and may have depressions or dimples on its surface for receiving and carrying the primer fluid.

The priming station 500 also has a pressurised air supply 505, which may be a chamber or canister of compressed air or gas, for example. The pressurised air may be at a pressure of 6 bar or 0.6 MPa in certain examples.

The priming station 500 comprises an addressable air knife 504 mounted opposite the metering roller 501. The addressable air knife 504 comprises a plurality of valves 515 in fluidic communication with the pressurised air supply 505. The plurality of valves 515 extend along a width of the metering roller 501 and are individually addressable to selectively remove primer fluid from the metering roller 501. The addressable air knife 504 may, in some examples, be an implementation of the apparatus for selectively removing primer described in previous examples with reference to FIGS. 1, 3*a* and 3*b*.

In certain cases, each of the plurality of valves 515 is pivotable about a common elongate member 525 and comprises a spring member 530 to bias a respective valve 515 in a closed configuration such that pressurised air from the pressurised air supply 505 is blocked by the valve 515. The plurality of valves 515 may be individually addressable by an actuator 520 to selectively pivot each of the plurality of valves 515 into an open configuration such that that pressurised air from the pressurised air supply 505 is supplied by the respective valve 515 to remove primer fluid from the metering roller 501. The valve 515 shown in FIG. 5 is in the open configuration. The plurality of valves 515 may be an implementation of the plurality of valves 315, 415 described in the examples shown in FIGS. 3*a*, 3*b*, and 4. Therefore, the relevant description regarding selectively pivoting the plurality of valves 315, 415 by an actuator 320, 420 described with reference to those examples applies to the plurality of valves 515 and the actuator 520 shown in FIG. 5.

In certain examples, the priming station 500 also comprises a plurality of latches 535 respectively coupled to the plurality of valves 515. Each of the plurality of latches 535 might comprise a spring member 550, and is configured to hold a respective valve 515 in the open configuration when said valve 515 is pivoted by the actuator 520, as shown in FIG. 5.

The plurality of latches may be individually pivotable about a second elongate member 540. For example, the second elongate member 540 might extend along the length of the addressable air knife 504. In some cases the second elongate member 540 is controllable to pivot the plurality of latches 535 and reset the plurality of valves 515 to the closed configuration. For example, the second elongate member 540 may be rotated or rolled to pivot all of the latches 535 to release all of the valves 515. This may be used to reset the plurality of valves 515 to the closed configuration, for example if they are biased in the closed configuration by spring members 530, as described. The addressable air knife 504 may therefore be switched between different configurations of the plurality of valves 515 (where the plurality of valves 315 are selectively pivoted in different arrangements or patterns) so that different patterns of primer fluid may be removed from the metering roller 501 before the primer fluid is transferred from the metering roller 501 to the print substrate.

In certain cases, the priming station 500 has a suction zone 570, with a vacuum supply 575, positioned below the addressable air knife 504. The suction zone 570 may collect primer fluid removed from the metering roller 501 for re-use. For example, as pressurised air from the pressurised air supply 505 exits the addressable air knife 504 through a selectively pivoted valve 515, the air stream or jet may split into two flows: a first—or "strike" flow 580; and a second—or "service" flow 585. The strike flow 580 may travel towards the metering roller 501 at approximately 100 m/s to remove primer fluid from the metering roller 501 as it rotates (e.g. about an axle 502) in a direction 503 (anticlockwise in the example of FIG. 5). The service flow 585 may travel downwards, carrying primer fluid residual that has been removed from the metering roller 501 by the strike flow 580. In this way, the service flow 585 may carry the primer fluid residual to the suction zone 570 where the vacuum supply 575 acts to draw the primer fluid residual. The removed primer fluid may be returned, via the suction zone 570, to a primer fluid supply (e.g. a reservoir of primer fluid for applying to the metering roller 501) somewhere in the printing system so that it may be re-used or recycled.

In certain examples, the addressable air knife 504 has a guide piece 555 to guide the pressurised fluid supply from the chamber 505, as described previously in the apparatus examples shown in FIGS. 3*a* and 3*b*. The guide piece 555 may guide the pressurised air from the chamber 505 through a narrow channel to form an air jet or curtain. The addressable air knife 504 may additionally or alternatively have a base part 560. The service flow 585 may flow along a surface of the base part 560 as it travels towards the suction zone 570.

The priming station 200, 500 described in examples, may in some cases have an interface to receive data indicative of a desired pattern of primer fluid application e.g. for a printing substrate or intermediate roller. The data may be in the form of a bitmap, for example, where the pattern of primer fluid application is represented by an array of bits, each bit defining whether primer fluid is present at that point in the array. The representative two-dimensional bitmap may be mapped to the surface of the printing substrate, intermediate roller, or metering roller 205, 501 to determine at what positions on the surface primer fluid should or should not be present for application to the printing substrate.

The priming station 200, 500 described might also be coupled to or comprise a controller to control the plurality of valves 515 of the addressable air knife 215, 504 to selectively remove primer fluid from the metering roller, for example in accordance with the data, received by the interface, indicative of the desired pattern of primer fluid application.

An environment of dry air in or surrounding the priming station 200, 500 may be detrimental to the primer fluid carried by the metering roller 205, 501. For example, dry air—air with a low relative humidity—may lead to polymerisation of the primer fluid, which is undesirable. Therefore, in one example, the priming station 200, 500 might comprise a humidified air supply to humidify the air surrounding the strike area—an area of the metering roller 205, 501 where the strike flow 580 acts to remove primer fluid. For example, the priming station 200, 500 might have a supply pipe connected to a humidifier in the printing system, the supply pipe directed to the strike area.

Figure 6:
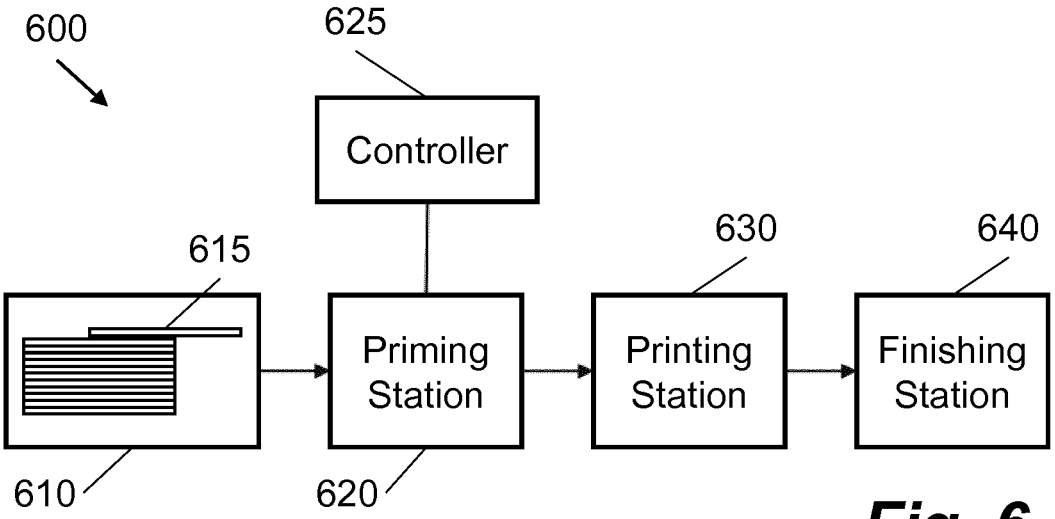
FIG. 6 is a schematic illustration showing a printing system including a priming station, according to an example.

FIG. 6 shows a printing system 600 according to an example. Certain examples described herein may be implemented as part of printing system 600.

In FIG. 6, the printing system 600 has a printing substrate feeder 610 to feed a printing substrate 615 to the priming station 620. The printing substrate 615 may comprise individual sheets or a web of print substrate. In the latter case, the printing substrate feeder 610 may comprise an unwinder.

At the priming station 620, which may correspond the priming station 200, 500 described in previous examples, priming fluid is applied to the printing substrate 615 from a metering roller. The primer fluid may be selectively removed from the metering roller before being applied to the print substrate. In other cases, primer fluid may be selectively removed directly from the print substrate. For example, the priming station 620 may comprise the metering roller, and may selectively remove primer fluid applied to the metering roller with a plurality of selectively pivotable valves (e.g. as part of an addressable air knife) as described in previous examples. The priming station 620 may comprise, or be connected to, a controller 625. The controller 625 may control the plurality of valves in the priming station 620, for example according to data received by, or inputted, to the controller 625 and/or the priming station 620. The data may be indicative of, or correspond to, a desired pattern of primer fluid application for the printing substrate 615. The data may be processed and resulting commands given by or to the controller 625 to control the plurality of valves according to the data.

The printing system 600 shown in FIG. 6 also comprises a printing station 630 to apply printing fluid, e.g. ink, to the printing substrate 615. The substrate 615 may be conveyed from the priming station 620, where primer is selectively applied to the substrate 615 e.g. by transferring primer fluid from the metering roller (or anilox roll) with primer fluid selectively removed to the printing substrate (e.g. via an intermediate roller), to the printing station 630. At the printing station 630, printing fluid may be transferred to the printing substrate 615 at particular locations on the surface of the printing substrate by a roller. The printing station 630 may comprise a liquid electrophotographic (LEP) printing device. The printing fluid may be applied as a layer on top of the primer fluid selectively applied to the printing substrate by the priming station 620. The primer fluid may increase adhesion of the printing fluid to the printing substrate 615.

The printing system 600 may have a finishing station 640, as shown in FIG. 6, to apply coating fluid to the printing substrate. The substrate 615 may be conveyed from the printing station 630 to the finishing station 640 as shown by the direction arrows in FIG. 6. The coating fluid comprises a fluid suitable for application in a printing process, for example a fluid for post treatment of the substrate 615, such as a varnish.

Figure 7:
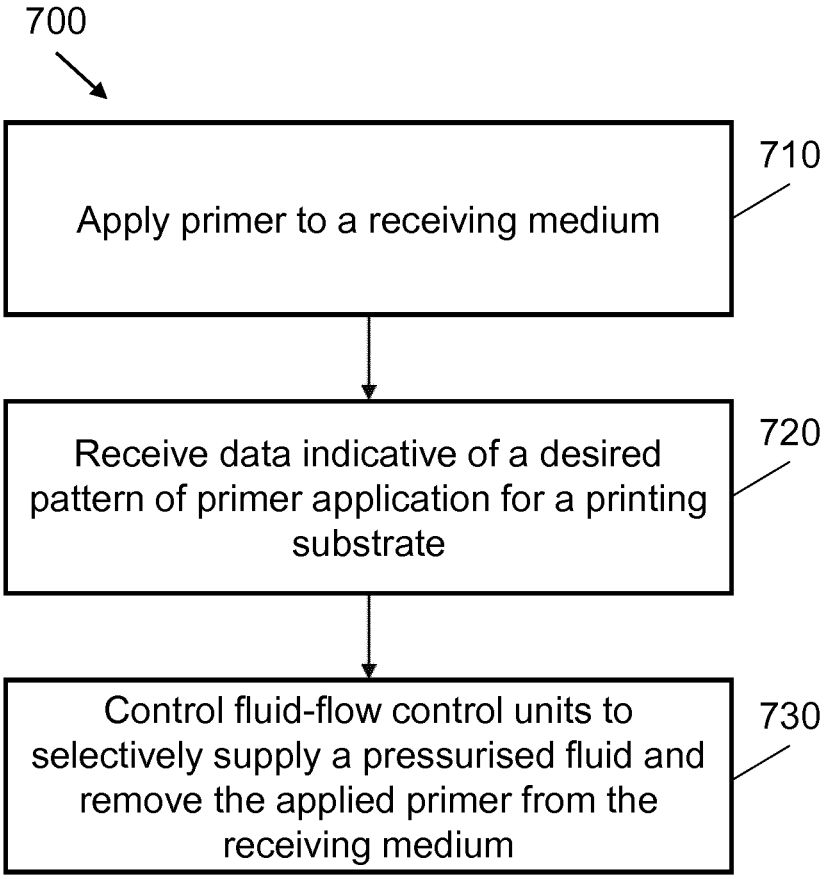
FIG. 7 is a flow diagram showing a method of applying primer in a printing system according to an example.

FIG. 7 shows a method 700 of applying primer in a printing system. The method 700 may be implemented using one of the apparatus previously described. The printing system may comprise one of the printing systems previously described.

At block 710, primer is applied to a receiving medium. The receiving medium may be a metering or anilox roller, or a printing substrate, for example. At block 720, data indicative of a desired pattern of primer application for a printing substrate is received. As described in other examples, the data may be a representation of where primer should and should not be applied to the printing substrate e.g. in a bitmap or similar format. At block 730, a series of fluid-flow control units—positioned opposite the receiving medium—are controlled in accordance with the received data to selectively supply a pressurised fluid and remove the applied primer from the receiving medium. The fluid-flow control units may be valves, as in the described apparatus examples, which are individually controllable to selectively supply pressurised fluid from a supply of the pressurised fluid such as a compressed gas chamber.

In one example, the method 700 may also comprise receiving further data indicative of a further desired pattern of primer application for a further printing substrate. In this example it may be desired to reconfigure the series of fluid-flow control units to selectively remove primer from the receiving medium in a different pattern. For example, the further data may relate to a new print job different to the previous print job. In this example, the method 700 further comprises resetting the series of fluid-flow control units, for example by returning all of the fluid-flow control units (or valves) to a closed configuration where the pressurised fluid is blocked from flowing by the fluid-flow control unit. In this example method 700, primer may then be applied to the receiving medium, and the series of fluid-flow control units may be controlled in accordance with the received further data to selectively supply the pressurised fluid and remove the applied primer from the receiving medium.

In one case, the method 700 may comprise controlling the series of fluid-flow control units to open all of the fluid-flow control units (or valves) such that primer is removed from the receiving medium along the entire width of the receiving medium. This may be used as a way of cleaning the receiving medium by removing all of the primer from the receiving medium e.g. in examples where the receiving medium is a metering or anilox roller.

In certain cases, the method 700 of applying primer in a printing system may comprise collecting, by suction, the primer removed from the receiving section. For example, a vacuum supply may be present, as described in the examples with reference to FIG. 5, to draw the primer removed from the receiving medium. The removed primer may be recycled to apply to the receiving medium in a later cycle of applying primer. For example, the removed primer may be transported, by piping or similar, to a central reservoir of primer fluid in the printing system to be applied to the receiving medium (e.g. the metering or anilox roller) again.

As previously described with reference to different apparatus and system examples, the selective application of primer to the printing substrate may precede or follow other operations in a printing process. For example, in particular cases, the method 700 may include receiving a printing substrate, transferring primer to the printing substrate, and transferring printing fluid to the printing substrate. In transferring primer to the printing substrate, this may be done by the receiving medium applying primer to the printing substrate, where the receiving medium has had primer selectively removed from it.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. Apparatus for selectively removing primer in a printing system comprising:

a chamber for supply of a pressurized fluid;

a plurality of valves fluidically coupled to the chamber and individually pivotable about a common elongate member that extends along a length of the apparatus, wherein each of the plurality of valves is configured to rotate about the common elongate member independently of other valves; and a set of actuators to pivot the plurality of valves about the common elongate member to selectively supply pressurized fluid from the chamber along the length of the apparatus.

2. The apparatus of claim 1, wherein each of the plurality of valves comprises a spring member and is biased in a closed configuration.

3. The apparatus of claim 1, wherein each of the set of actuators is moveable along a length of the common elongate member, to selectively pivot multiple valves within the plurality of valves.

4. The apparatus of claim 1, comprising a plurality of latches respectively coupled to the plurality of valves, and individually pivotable about a second elongate member that extends along the length of the apparatus, wherein each of the plurality of latches is configured to hold a valve in an open configuration, such that the pressurized fluid from the chamber is supplied by the valve, when the valve is pivoted by the set of actuators.

5. The apparatus of claim 4, comprising a second set of actuators to pivot the plurality of latches about the second elongate member to selectively release the plurality of latches and selectively close the plurality of valves.

6. A priming station for a printing system, comprising:

a metering roller to carry primer fluid for application to a printing substrate;

a pressurized air supply; and an addressable air knife mounted opposite the metering roller and comprising a plurality of valves in fluidic communication with the pressurized air supply, wherein each of the plurality of valves is pivotable about a common elongate member independently of other valves, extends along a width of the metering roller and is individually addressable to selectively remove primer fluid from the metering roller.

7. The priming station of claim 6, wherein each of the plurality of valves is pivotable about a common elongate member and comprises a spring member to bias a respective valve of the plurality of valves in a closed configuration such that pressurized air from the pressurized air supply is blocked by the valve, and wherein the plurality of valves are individually addressable by an actuator to selectively pivot each of the plurality of valves into an open configuration such that that pressurized air from the pressurized air supply is supplied by the respective valve of the plurality of valves to remove primer fluid from the metering roller.

8. The priming station of claim 7, comprising a plurality of latches respectively coupled to the plurality of valves, wherein each of the plurality of latches comprises a spring member and is configured to hold the respective valve of the plurality of valves in the open configuration when said valve is pivoted by the actuator.

9. The priming station of claim 8, wherein the plurality of latches are individually pivotable about a second elongate member, wherein the second elongate member is controllable to pivot the plurality of latches and reset the plurality of valves to the closed configuration.

10. The priming station of 6, comprising a suction zone having a vacuum supply positioned below the addressable air knife to collect primer fluid removed from the metering roller for re-use.

11. The priming station of claim 6 comprising:

an interface to receive data indicative of a desired pattern of primer fluid application for a printing substrate; and a controller to control the plurality of valves of the addressable air knife to selectively remove primer fluid from the metering roller.

12. A method of applying primer in a printing system, comprising:

applying primer to a receiving medium;

receiving data indicative of a desired pattern of primer application for a printing substrate; and controlling a series of fluid-flow control units positioned opposite the receiving medium in accordance with the received data to selectively supply a pressurized fluid and remove the applied primer from the receiving medium, wherein each of the series of fluid-flow control units is configured to rotate about a common elongate member independently.

13. The method of claim 12, comprising:

receiving further data indicative of a thither desired pattern of further primer application for a further printing substrate;

resetting the series of fluid-flow control units;

re-applying primer to the receiving medium; and controlling the series of fluid-flow control units in accordance with the received further data to selectively supply the pressurized fluid and remove the re-applied primer from the receiving medium.

14. The method of claim 12, comprising:

collecting, by suction, the primer removed from the receiving mediums; and recycling the removed primer to apply to the receiving medium.

15. The method according to claim 12, comprising:

receiving a printing substrate;

transferring primer to the printing substrate; and transferring printing fluid to the printing substrate.

* * * * *